United States Patent [19]

Jack et al.

[11] 4,209,726

[45] Jun. 24, 1980

[54] LOW-PRESSURE SODIUM VAPOR DISCHARGE LAMP

[75] Inventors: Alexander G. Jack, Eindhoven; Franciscus N. C. Baeten, Nijmegen; Johannes van de Bilt, Eindhoven, all of Netherlands

[73] Assignee: U.S. Philips Corporation, New York, N.Y.

[21] Appl. No.: 952,370

[22] Filed: Oct. 18, 1978

[30] Foreign Application Priority Data

Nov. 2, 1977 [NL] Netherlands ..... 7712059

[51] Int. Cl.[2] ..... H01J 61/22; H01J 61/26; H01J 61/30

[52] U.S. Cl. ..... 313/174; 313/221; 313/227

[58] Field of Search ..... 313/225, 227, 174, 221

[56] References Cited

U.S. PATENT DOCUMENTS

| | | | |
|---|---|---|---|
| 2,899,584 | 8/1959 | Verwey | 313/225 X |
| 3,134,920 | 5/1964 | van de Weijer et al. | 313/225 X |
| 3,416,022 | 12/1968 | Mayer | 313/225 X |
| 3,678,315 | 7/1972 | Wesselink et al. | 313/225 X |

FOREIGN PATENT DOCUMENTS

| | | | |
|---|---|---|---|
| 947311 | 1/1964 | United Kingdom | 313/221 |

*Primary Examiner*—Palmer C. Demeo
*Attorney, Agent, or Firm*—Robert S. Smith

[57] ABSTRACT

A low-pressure sodium vapor discharge lamp having electrodes at the ends of the discharge vessel, the lamp comprising means which prevent the vapor pressure of sodium in the discharge vessel from exceeding $3\times10^{-5}$ torr during the life of the lamp.

5 Claims, 1 Drawing Figure

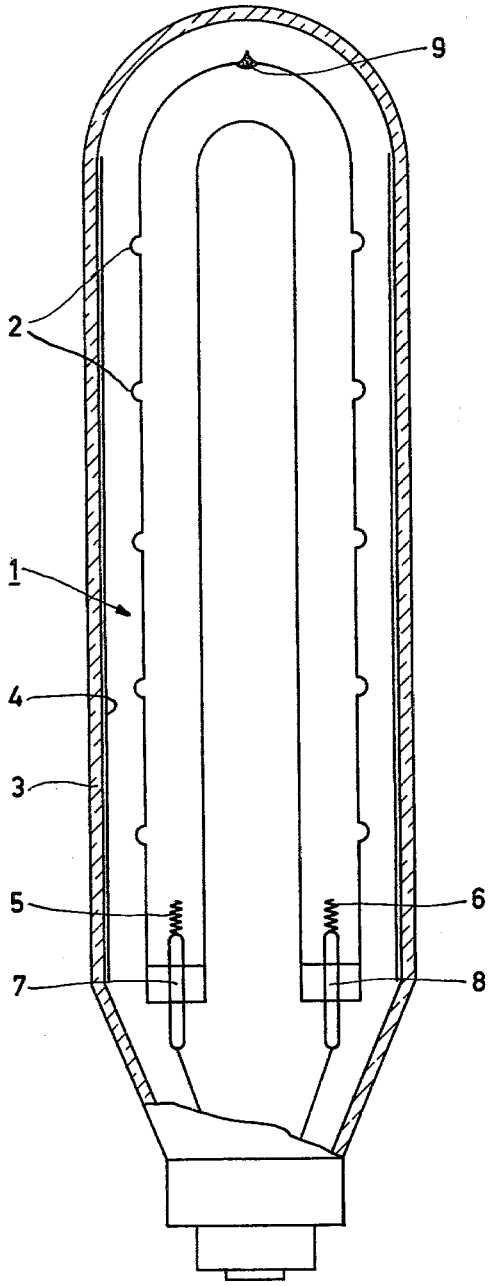
9
2
1
4
3
5
6
7
8

LOW-PRESSURE SODIUM VAPOR DISCHARGE LAMP

The invention relates to a low-pressure sodium vapor discharge lamp having a potassium containing glass discharge vessel which is provided with electrodes at each end. Such a lamp is disclosed in United Kingdom Patent Specification No. 1,122,866.

From experiments it appeared that in low-pressure sodium vapor discharge lamps the efficiency of the conversion of the applied electric power into visible radiation decreases during operation of the lamp owing to the occurrence of resonant lines, which are located in the infrared range of the spectrum. It was found that these resonant lines originate from potassium.

It was determined that one of the most important causes of the presence of potassium vapor in the discharge vessel is the fact that the glass wall of the discharge vessel contains potassium or a potassium compound. It is therefore possible that during operation of the lamp potassium is released from the glass wall owing to a locally high temperature in the discharge vessel. This is particularly the case in that portion of the discharge vessel where the supply leads of the electrodes are fastened by means of a special sealing glass. Such a sealing glass, which properly fuses to the current supply lead, allows proper softening during manufacture of the lamp—the current supply leads are fastened in the discharge vessel by means of a pinch connection—and is sufficiently resistent to the action of the sodium discharge, generally contains a relatively high percentage of potassium or a potassium compound, such as potassium oxide. An example of a suitable sealing glass which can be used in low-pressure sodium vapor discharge lamps is sealing glass of the following composition (in wt.%): 62.3% $SiO_2$; 2.0% $B_2O_3$; 8.4% $Na_2O$; 10.7% $K_2O$; 14.3% BaO; 2.0% $Al_2O_3$ and 0.2% F. Owing to the high temperature of the electrode, potassium is released from the glass in the course of operation of the lamp and the previously mentioned conversion efficiency decreases.

It is an object of the invention to provide a low-pressure sodium vapor discharge lamp in which measures have been taken to obviate the above drawback.

A low-pressure sodium vapor discharge lamp of the type defined in the preamble is characterized in accordance with the invention in that the lamp comprises means which prevent the vapor pressure of potassium in the discharge vessel from exceeding $3\times10^{-5}$ torr during the life of the lamp.

It appeared that, if the partial potassium vapor pressure of the gas mixture present in the discharge vessel can be reduced to a value below $3\times10^{-5}$ torr, the contribution to the total radiation of the resonant lines originating from potassium is so low at a given supplied electric power in the course of operation that said conversion efficiency of the lamp remains substantially constant during its total life.

In an embodiment of a lamp according to the invention at least that part of the wall of the discharge vessel which extends between the electrodes comprises glass containing less than 5% by weight of potassium.

An example of a suitable potassium-poor glass for this purpose is gehlenite glass which contains less than 0.1% of potassium by weight. In this manner it can be prevented that, during the life of the lamp, such a large quantity of potassium is released from the glass and moves into the discharge vessel at a locally high temperature in the discharge vessel that the partial potassium vapor pressure exceeds $3\times10^{-5}$ torr.

In another embodiment of a lamp according to the invention a potassium absorbing getter is provided in the discharge vessel. Any potassium vapor present in the discharge vessel is absorbed by the potassium getter. In the course of operation the partial potassium-vapor pressure remains below $3\times10^{-5}$ torr. The power of the transmitted potassium radiation is then very low, compared to the electric power supplied. An example of a suitable potassium absorbing getter is sodium iodide which is, for example, applied in the bent portion of a U-shaped discharge vessel of a low-pressure sodium vapor discharge lamp in the form of a powder layer.

Compared to the power supplied to the lamp the power of the transmitted potassium resonant radiation is also low if a relatively large quantity of sodium is applied in the discharge vessel during manufacture of the lamp. It appeared that if a quantity of sodium which is approximately a factor of 20 higher than usual for low-pressure sodium lamps is applied, the partial potassium pressure built up in the discharge vessel, during the life of the lamp is lower than $3\times10^{-5}$ torr. For lamps whose discharge vessel contains the previously mentioned sealing glass it appeared that, at an operating temperature of approximately 260° C., a quantity of sodium per unit of volume is required which exceeds 0.05 g per $cm^3$ of the enclosed volume of the discharge vessel.

In another embodiment of a low-pressure sodium vapor discharge lamp according to the invention means are present in the discharge vessel, at least in the region where there is potassium-containing glass, for keeping the temperature in the discharge vessel, in the region of the potassium-containing glass, below 260° C. at an ambient temperature of the lamp of approximately 20° C. The risk that an excessive quantity of potassium is released from the glass wall is then low. An example of a suitable means in lamps in which the feedthroughs of the electrodes are fastened in the discharge vessel by means of a potassium-containing sealing glass in a construction in which the spacing from the electrodes to said sealing glass is relatively large.

An embodiment of a low-pressure sodium vapor discharge lamp according to the invention will be further explained by way of non-limitative example with reference to a drawing.

The drawing shows a longitudinal cross-section of a low-pressure sodium vapor discharge lamp according to the invention having a power of 90 Watts.

Reference numeral 1 denotes the U-shaped discharge vessel of the low-pressure sodium vapor discharge lamp shown in the drawing. The discharge vessel contains a borate glass which is resistant to the action of a low-pressure sodium discharge.

The composition of this glass is as follows: (in wt.%): 4.8% $SiO_2$; 19.1% $B_2O_3$; 10.2% CaO; 50.7% BaO; 5.2% MgO; 8.5% $Al_2O_3$; 0.5% SrO; 0.8% $K_2O$. The discharge vessel length (80 cm internal, diameter 20 mm) is provided with a plurality of bulges 2, over which the sodium is distributed during manufacture of the lamp. Next to sodium (approximately 750 mg) a small quantity of noble gas or a mixture of noble gasses, (for example a mixture of argon and neon at a pressure of 4 torr) is present in the discharge vessel. The discharge vessel is enclosed in an evacuated outer bulb 3, the inner wall of which is provided with a heat-reflecting coating 4.

Electrodes 5 and 6 are respectively disposed at the ends of each legs of the U-shaped discharge vessel. Supply leads 7 and 8, respectively, of these electrodes comprise copper clad wire and are fastened in a gas-tight manner in the discharge vessel by means of sealing glass during a pinching process. The sealing glass is of the following composition: (in wt.%): 62.3% $SiO_2$; 2.0% $B_2O_3$; 8.4% $Na_2O$; 10.7% $K_2O$; 14.3% BaO; 2.0% $Al_2O_3$ and 0.2% F.

A potassium absorbing-getter 9 in the form of 40 mg of sodium iodide is disposed in the U-shaped discharge vessel. The potassium released during operation of the lamp and present in the discharge vessel is absorbed by this getter so that the partial potassium vapor pressure is approximately 0.01 millitorr at an operating temperature of 260° C. The power of the transmitted potassium resonant radiation is less than 0.5% of the power supplied to the lamp. The efficiency of the lamp described here was, after 7500 hours operation, approximately 140 lm/W. In a comparable lamp without the getter this efficiency was approximately 120 lm/W.

What is claimed is:

1. A low-pressure sodium vapor discharge lamp having a potassium-containing glass discharge vessel, two electrodes disposed in said vessel, and means for preventing the vapor pressure of potassium in the discharge vessel from exceeding $3\times10^{-5}$ torr during the life of the lamp, said means comprises a potassium absorbing getter disposed in the discharge vessel.

2. A low-pressure sodium vapor discharge lamp as claimed in claim 1, wherein said means further includes at least a part of the wall of the discharge vessel which extends between the electrodes comprises glass, containing less than 5% by weight of potassium in the form of potassium compounds.

3. A low-pressure sodium vapor discharge lamp as claimed in claim 1, wherein said potassium absorbing getter comprises sodium iodide.

4. A low-pressure sodium vapor discharge lamp as claimed in claim 1, 2 or 3, wherein the quantity of sodium in the discharge vessel exceeds 0.05 gms per cubic centimeter of the enclosed volume of the discharge tube.

5. A low-pressure sodium vapor discharge lamp as claimed in claim 1, 2 or 3, wherein said means is present in the discharge vessel, at least in the region where there is potassium-containing glass, for keeping the temperature in the discharge vessel in the region of the potassium-containing glass below 260° at an ambient temperature of the lamp of 20° C.

* * * * *